US007869751B2

(12) United States Patent
Adachi et al.

(10) Patent No.: US 7,869,751 B2
(45) Date of Patent: Jan. 11, 2011

(54) TRANSFER DEVICE AND IMAGE FORMING APPARATUS

(75) Inventors: Tomoya Adachi, Hyougo (JP); Takeshi Yamashita, Osaka (JP); Takafumi Miyazaki, Osaka (JP); Yuuji Meguro, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 407 days.

(21) Appl. No.: 12/135,460

(22) Filed: Jun. 9, 2008

(65) Prior Publication Data

US 2008/0310893 A1 Dec. 18, 2008

(30) Foreign Application Priority Data

Jun. 18, 2007 (JP) ..... 2007-159888

(51) Int. Cl.

| | |
|---|---|
| ***G03G 15/00*** | (2006.01) |
| ***G03G 21/00*** | (2006.01) |
| ***G03G 15/20*** | (2006.01) |
| ***G03G 15/16*** | (2006.01) |

(52) U.S. Cl. ..... 399/316; 399/71; 399/99; 399/314; 399/317; 399/345

(58) Field of Classification Search ..... 399/71, 399/98–101, 314, 316, 317, 345, 357
See application file for complete search history.

(56) References Cited

U.S. PATENT DOCUMENTS

| | | | | |
|---|---|---|---|---|
| 6,108,510 | A * | 8/2000 | Nakane | 399/303 |
| 2004/0258439 | A1 * | 12/2004 | Izumi | 399/316 |
| 2006/0210326 | A1 | 9/2006 | Takehara et al. | |
| 2006/0210327 | A1 | 9/2006 | Iwakura et al. | |
| 2007/0160396 | A1 | 7/2007 | Adachi et al. | |
| 2007/0183816 | A1 | 8/2007 | Hatayama et al. | |
| 2007/0217832 | A1 * | 9/2007 | Oyama et al. | 399/302 |
| 2007/0231023 | A1 | 10/2007 | Miyazaki | |
| 2007/0269233 | A1 | 11/2007 | Sakashita et al. | |
| 2008/0028967 | A1 | 2/2008 | Sakashita et al. | |
| 2008/0050158 | A1 | 2/2008 | Hatayama et al. | |

FOREIGN PATENT DOCUMENTS

| | | | |
|---|---|---|---|
| JP | 2001117375 A | * | 4/2001 |
| JP | 2002-132065 | | 5/2002 |
| JP | 4038238 | | 11/2007 |

OTHER PUBLICATIONS

U.S. Appl. No. 12/135,490, filed Jun. 9, 2008, Miyazaki, et al.

* cited by examiner

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

An endless belt is supported by a plurality of rollers. A transfer roller comes in contact with an outer surface of the belt to form a transfer nip. An auxiliary member makes contact with a recording medium on an upstream side of the transfer nip in a movement direction of the belt, to cause the recording medium to be in close contact with the outer surface of the belt. A bias applying unit applies to the auxiliary member a bias for electrostatically transferring a toner adhered to the auxiliary member to the outer surface of the belt.

17 Claims, 8 Drawing Sheets

TRANSFER DEVICE AND IMAGE FORMING APPARATUS

CROSS-REFERENCE TO RELATED APPLICATIONS

The present application claims priority to and incorporates by reference the entire contents of Japanese priority document 2007-159888 filed in Japan on Jun. 18, 2007.

BACKGROUND OF THE INVENTION

1. Field of the Invention

The present invention relates to an image forming apparatus such as a printer, a copier, or a facsimile apparatus, and to a transfer device used in such an image forming apparatus. The invention particularly relates to an image forming apparatus and a transfer device that include an auxiliary member that causes a recording medium to adhere to a transfer belt.

2. Description of the Related Art

An image forming apparatus has been know that transfers a toner image on a photosensitive element to an intermediate transfer belt at a primary transfer section, and then transfers the toner image on the intermediate transfer belt to a recording medium at a secondary transfer section. To transfer the toner image on the intermediate transfer belt to the recording medium at the secondary transfer section, the recording medium is conveyed in synchronization with the toner image on the intermediate transfer belt, and is passed through an area affected by a transfer electric field at the secondary transfer section, while being in contact with the intermediate transfer belt. In this way, the toner image can be transferred to the recording medium from the intermediate transfer belt because of the transfer electric field.

In such an image forming apparatus with a transfer system, when a gap appears between a surface of the recording medium receiving a toner image thereon and a surface of the intermediate transfer belt carrying a toner image on the upstream side of the secondary transfer section in a movement direction of the intermediate transfer belt, electrical discharge may occur because of the transfer electric field, causing image defects such as pinholes.

Japanese Patent Application Laid-open No. 2001-356538 discloses an image forming apparatus in which an auxiliary member, provided upstream of a transfer area on a secondary transfer section in a movement direction of an intermediate transfer belt, presses a backside of a recording medium, i.e., a reverse side of a surface receiving a toner image transferred thereto, and thus maintains the adhesion of the recording medium to the intermediate transfer belt. The auxiliary member causes the recording medium to adhere to the intermediate transfer belt, thereby preventing a gap between the recording medium and the intermediate transfer belt before the transfer area and suppressing electrical discharge.

Toner flowing around the secondary transfer section or the like inside a main body or toner on the intermediate transfer belt may adhere to the auxiliary member, causing the adhesion auxiliary member to be soiled with the toner. This causes a problem in that, because the auxiliary member presses the backside of the recording medium, the backside of the recording medium is soiled with the toner adhered to the auxiliary member.

The foregoing describes an image forming apparatus with an intermediate transfer system that transfers a toner image from an intermediate transfer belt to a recording medium. The same problem may occur also when a latent image formed on a belt-like latent image carrier is developed with toner and the toner image thus developed is transferred to a recording medium.

As another structure, the auxiliary member may be provided upstream of a transfer nip, formed with an image carrier and a recording medium conveyor belt, in a movement direction of the recording medium conveyor belt. In this structure, the recording medium can be conveyed to the transfer nip in contact with the recording medium conveyor belt. Even with this structure, to contact firmly the recording medium to the recording medium conveyor belt, an outer surface of the recording medium carried on the recording medium conveyor belt, i.e., a surface onto which a toner image is transferred, is brought into contact with the auxiliary member, allowing the recording medium to be adhered to the recording medium transport belt. This may also cause the same problem that the outer surface of the recording medium is soiled with the toner adhered to the auxiliary member when the recording medium comes in contact with the auxiliary member.

In some aspects of the present invention, the bias applying unit applies to the auxiliary member the cleaning bias for causing the toner adhered to the auxiliary member to be electrostatically transferred therefrom to the belt-like image carrier. The cleaning bias at least has the same polarity as a normal charge polarity of the toner. By electrostatically transferring the toner adhered to the auxiliary member to the belt-like image carrier, the auxiliary member can be cleaned to have no toner adhesion. Further, the toner transferred from the auxiliary member to the belt-like image carrier can be collected by, for example, a cleaning device that cleans the outer surface of the belt-like image carrier. This prevents the transferred toner from adhering to the auxiliary member again.

SUMMARY OF THE INVENTION

It is an object of the present invention to at least partially solve the problems in the conventional technology.

According to an aspect of the present invention, there is provided a transfer device that includes an endless belt that is supported by a plurality of rollers, a transfer roller that comes in contact with an outer surface of the belt to form a transfer nip, and an auxiliary member that makes contact with a recording medium on an upstream side of the transfer nip in a movement direction of the belt, to cause the recording medium to be in close contact with the outer surface of the belt. The transfer device transfers a toner image formed on the outer surface of the belt to the recording medium nipped in the transfer nip. The transfer device further includes a bias applying unit that applies to the auxiliary member a bias for electrostatically transferring a toner adhered to the auxiliary member to the outer surface of the belt.

Furthermore, according to another aspect of the present invention, there is provided an image forming apparatus including an image carrier on which a latent image is formed; a latent image forming unit that forms the latent image on the image carrier; a developing unit that develops the latent image formed on the image carrier with toner to form a toner image; and a transfer unit that transfers the toner image formed on the image carrier to a recording medium. The transfer unit includes an endless belt that is supported by a plurality of rollers and makes an endless movement, a transfer roller that comes in contact with an outer surface of the belt to form a transfer nip, an auxiliary member that makes contact with the recording medium on an upstream side of the transfer nip in a movement direction of the belt, to cause the recording medium to be in close contact with the outer surface of the belt, and a bias applying unit that applies to the auxiliary member a bias for electrostatically transferring a toner adhered to the auxiliary member to the outer surface of the belt.

Moreover, according to still another aspect of the present invention, there is provided an image forming apparatus including an image carrier on which a latent image is formed; a latent image forming unit that forms the latent image on the image carrier; a developing unit that develops the latent image formed on the image carrier with toner to form a toner image; and a transfer unit that transfers the toner image formed on the image carrier to a recording medium. The transfer unit includes an endless belt that is supported by a plurality of rollers and makes an endless movement, a transfer roller that comes in contact with an outer surface of the belt to form a transfer nip, an auxiliary member that makes contact with the recording medium on an upstream side of the transfer nip in a movement direction of the belt, to cause the recording medium to be in close contact with the outer surface of the belt, a bias applying unit that applies to the auxiliary member a bias for electrostatically transferring a toner adhered to the auxiliary member to the outer surface of the belt, and a housing that accommodates the auxiliary member and the transfer roller. The housing is held on a cover rotatable with respect to a main body of the image forming apparatus in a direction perpendicular to a conveying direction of the recording medium.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 2:
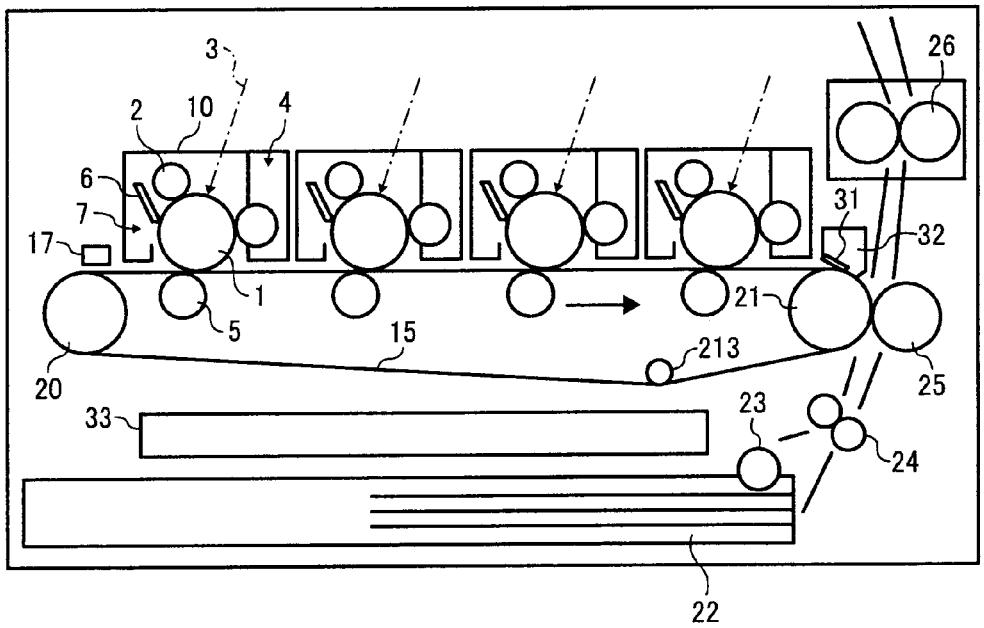
FIG. 2 is a schematic diagram of a printer according to a first embodiment of the present invention.

FIG. 2 is a schematic diagram of a printer that is an image forming apparatus according to a first embodiment of the present invention. Photosensitive elements 1 each formed in a cylindrical drum shape with $\phi 24$ rotate at a circumferential velocity of 120 mm/s. On respective surfaces of the photosensitive elements 1 are pressure-fitted brush-like chargers 2 serving as charging units that rotate following the rotation of the photosensitive elements 1. With application of a direct current or a bias having an alternate current superimposed on a direct current from a high voltage power source (not shown), each of the photosensitive elements 1 is uniformly charged to have a surface potential of −500 volts.

In the photosensitive elements 1, image information is then exposed to light by exposing units 3 serving as latent image forming units, so that static latent images are respectively formed. This exposing process is performed with a laser beam scanner using laser diodes or with light emitting diodes (LEDs) etc.

Developers 4 (for one-component contact development) serving as developing units visualize static latent images on the photosensitive elements 1 as toner images with application of a predetermined developing bias supplied from the high voltage power source (not shown). Each of the developers 4 initially stores therein 180 grams of one-component toner having a negative polarity as a normal charge polarity.

The photosensitive elements 1, the chargers 2, and the developers 4 constitute four processing units 10 that are detachable with respect to a printer main body, and arranged in parallel. To form a full color image, visible toner images are formed in the order of yellow (Y), magenta (M), cyan (C), and black (Bk). The toner images of the respective colors are sequentially transferred to and superimposed on top of another on an intermediate transfer belt 15 that constantly comes in contact, so that a full color image is formed.

The intermediate transfer belt 15 in an intermediate transfer unit 50 is stretched by a secondary transfer facing roller 21 serving as a drive roller, first transfer rollers 5, a tension roller 20, and a stretching roller 213. Further, the intermediate transfer belt 15 is rotationally driven by a drive motor (not shown) via the secondary transfer facing roller 21. The belt tension is applied with springs provided at both ends of the tension roller 20. The tension roller 20 is formed in an aluminum pipe shape with $\Phi 20$, and both ends thereof have collars (not shown) with Φ24 pressed therein and serving as regulating members that regulate the meander of the intermediate transfer belt 15.

For the secondary transfer facing roller 21, a polyurethane rubber (radial thickness of 0.3 mm to 1 mm), a thin-film coating roller (radial thickness of 0.03 mm to 0.1 mm) may be used. The present embodiment employs a urethane coating roller having a small radial fluctuation due to temperature (radial thickness of 0.05 mm, Φ20).

As a first transfer member, a conductive blade, a conductive sponge roller, a metal roller, or the like may be used. The present embodiment employs the first transfer rollers 5 made of a metal roller with Φ8. The first transfer rollers 5 are provided at an offset of 8 mm in the movement direction of the intermediate transfer belt 15 and at an offset of 1 mm in a vertically upward direction, against the photosensitive element 1. A predetermined transfer bias of +500 volts to +1000 volts from a single high voltage power source (not shown) is applied commonly to the first transfer rollers 5, so that transfer electric fields are respectively formed on the photosensitive elements 1 with the intermediate transfer belt 15 therebetween. Accordingly, each of the toner images on the photosensitive elements 1 is transferred to the intermediate transfer belt 15.

The toner mark sensor (TM sensor) 17 measures the concentration of toner images on the intermediate transfer belt 15 and the position of each color thereof using a specular sensor or a diffusion sensor, during adjustment of the image concentration or color matching.

An intermediate transfer belt cleaning unit 32 removes and cleans post-transfer residual toner on the intermediate transfer belt 15 using a cleaning blade 31. The cleaning blade 31, made of a urethane rubber having a thickness of 1.5 mm to 3 mm and a hardness of 65 degrees to 80 degrees, is brought into contact with the intermediate transfer belt 15 in a reverse direction of the movement direction. The post-transfer residual toner thus removed is passed through a toner conveyance path (not shown) and housed in a container 33 for toner discharged from the intermediate transfer belt. During assembly, an embrocation such as a lubricant agent, toner, or zinc stearate is applied at least either to a portion corresponding to a cleaning nip of the intermediate transfer belt 15 or to an edge of the cleaning blade 31. This prevents the cleaning blade from riding up at the cleaning nip, and enhances cleaning performance by forming a dam layer at the cleaning nip.

The rollers stretching the intermediate transfer belt 15 are supported at the both sides of the intermediate transfer belt 15, with side plates of an intermediate transfer unit (not shown).

For the intermediate transfer belt 15, an endless belt of a resin film is used in which a conductive material such as carbon black is dispersed to polyvinylidine difluoride (PVDF), ethylene-polytetrafluoroethylene copolymer (ETFE), polyimide (PI), polycarbonate (PC), thermoplastic elastomer (TPE), or the like. The present embodiment employs a belt member configured as a single layer having a thickness of 100 μm to 200 μm and a width of 230 mm and including carbon black added to TPE having a modulus of elongation of 1000 MPa to 2000 MPa.

It is desirable that the intermediate transfer belt 15 have: a volume resistance of $10^8$ Ω·cm to $10^{11}$ Ω·cm; and a sheet resistance of $10^8$ Ω/sg to $10^{11}$ Ω/sg (both measured with HirestaUP MCP-HT450 made by Mitsubishi Chemical Corporation, with application voltage of 500 volts for 10 seconds), under 50% relative humidity (RH) and 23° C. When the volume resistance and the sheet resistance of the intermediate transfer belt 15 exceed the above ranges, the intermediate transfer belt 15 is charged. Accordingly, such measures are required as setting a higher voltage at a position closer to the downstream side in the direction of image creation. This causes difficulty in using the power independently supplied to the first transfer section because the surface of the intermediate transfer belt 15 has an increased charged potential due to the discharge caused in the transfer process or a recording medium detachment process etc., thus having difficulties in self-discharge. To address the difficulties, a neutralizing unit needs to be provided for the intermediate transfer belt 15. On the contrary, when the volume resistance and the sheet resistance fall below the ranges, the charged potential is reduced rapidly. This is advantageous for neutralizing by self-discharge, however, toner scatters due to the current flowing in a plane direction during the transfer. For this reason, the volume resistance and the sheet resistance of the intermediate transfer belt 15 are set within the above ranges in the present embodiment.

At the secondary transfer section, a secondary transfer roller 25 faces the secondary transfer facing roller 21 with the intermediate transfer belt 15 therebetween, to form a secondary transfer nip N with the intermediate transfer belt 15. The secondary transfer roller 25 includes a metal cored bar, such as a steel use stainless (SUS), with an elastic body coated on the metal cored bar. The elastic body is made of, for example, urethane adjusted with a conductive material to have a resistance $10^6$Ω to $10^{10}$Ω. The secondary transfer roller 25 is formed with an ion conductive roller (urethane+carbon dispersion, butadiene-acrylonitrile copolymer rubber (NBR), hydrin), an electronically conductive roller (ethylene propylene diene monomer (EPDM)). The present embodiment employs a urethane roller having a Φ20 and a hardness ranging from 35 degrees to 50 degrees on ASKER C scale. Because the current does not flow well when the resistances of the secondary transfer roller 25 exceed the above ranges, a high voltage needs to be applied to achieve the transfer as required, causing a power cost increase. Further, because a high voltage needs to be applied, discharge occurs in gaps around the secondary transfer nip, causing white pinholes on a halftone image because of the discharge. This is typically seen under low temperature and low humidity (e.g., at 15% relative humidity and 10° C.). On the contrary, when the resistances of the secondary transfer roller 25 fall below the ranges, the compatibility is not achieved between the transfer of a multi-color image section (e.g., three-color superimposed image) and the transfer of a monochromatic image section on the same image. Specifically, because the secondary transfer roller 25 has low resistances, sufficient current flows at a relatively low voltage for transferring the monochromatic image section. However, for transferring the multicolor image section, a voltage higher than an optimum voltage needs to be applied to the monochromatic image section. Thus, setting a voltage sufficient for transferring the multicolor image section causes an excessive current flow for the transfer of the monochromatic image section, and transfer efficiency is degraded.

To measure the resistances of the secondary transfer roller 25, the secondary transfer roller 25 is set on a conductive metal plate, and a force of 4.9 N is applied to each end of the metal cored bar. The resistances are then calculated based on the current flowing upon application of 1 kilovolt between the metal cored bar and the metal plate.

A recording medium 22 is fed by a paper feed roller 23 and a pair of registration rollers 24 at the time when the leading end of a toner image on the surface of the intermediate transfer belt 15 reaches the secondary transfer position. Then, the toner image on the intermediate transfer belt 15 is transferred to the recording medium 22 with application of a predetermined transfer bias from a high voltage power source (not shown). The recording medium 22 is detached from the intermediate transfer belt 15 due to the curvature of the secondary transfer facing roller 21, and then discharged after the toner image thus transferred to the recording medium 22 is fixed by a fixing unit 26.

In the present embodiment, the processing speed during the fixing is changed depending on the type of the recording medium 22. Specifically, when the recording medium having a basis weight of not less than 100 g/m$^2$ is used, the processing speed is set at half the normal processing speed. Further, the recording medium 22 passes through a fixing nip between a pair of fixing rollers in the fixing unit 26 to take the time twice as much as the normal processing time. In this way, the toner image is securely fixed.

Figure 1:
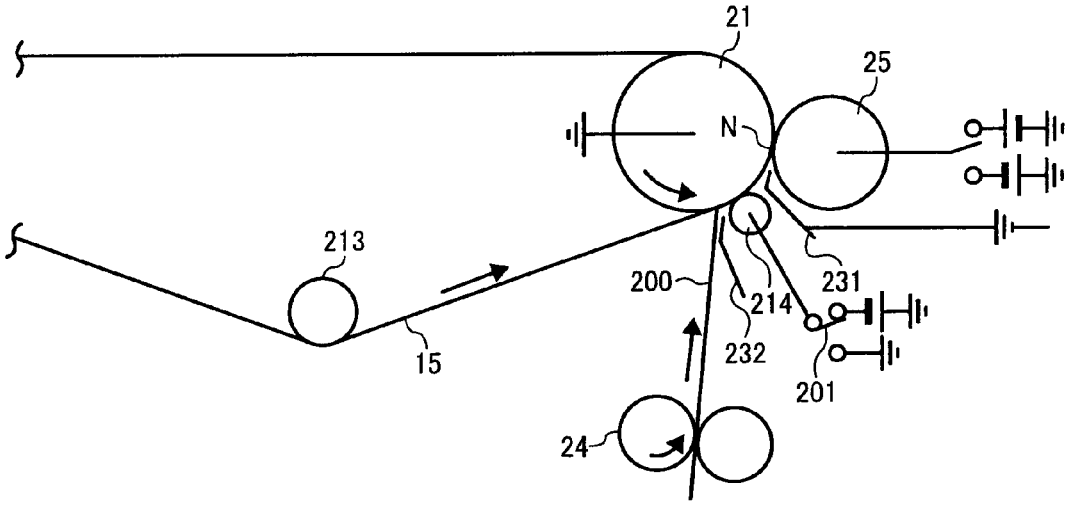
FIG. 1 is a schematic diagram of a portion, near a secondary transfer section, of an intermediate transfer unit according to a first arrangement of the present invention.

In FIG. 1, near an upstream position of the secondary transfer nip N in the movement direction of the intermediate transfer belt, an auxiliary roller 214 is provided to be in contact with the intermediate transfer belt 15. The auxiliary roller 214 serves as an auxiliary member that causes the recording medium 22 to adhere to the intermediate transfer belt. The auxiliary roller 214 is rotatably supported and can be moved by a moving unit (not shown) toward the intermediate transfer belt 15. The auxiliary roller 214 presses the recording medium 22 to the surface of the intermediate transfer belt 15, at the arrival of the leading end of the recording medium 22 being in contact with the intermediate transfer belt 15.

When the recording medium 22 is sent out from the registration rollers 24, the recording medium 22 is guided to a first guiding member 232, and the leading end of the recording medium 22 hits a portion of the surface of the intermediate transfer belt 15, i.e., an upstream portion slightly away from the auxiliary roller 214 in the movement direction of the intermediate transfer belt. The leading end of the recording medium 22 is nipped between the auxiliary roller 214 and the intermediate transfer belt 15 at the time when approaching a position where a pressure is applied by the auxiliary roller 214. When the leading end of the recording medium 22 hits the surface of the intermediate transfer belt 15, a switch 201 is switched and the auxiliary roller 214 is grounded. Accordingly, the auxiliary roller 214 and the drive roller 211 are grounded to have the same potential. As a result, even when a slight gap occurs immediately before the auxiliary roller 214, image deterioration due to the discharge is prevented.

Assume that the recording medium 22 is not conveyed, for example, when the process control or color registration is activated or during jam processing. In this case, when the leading end of the toner image on the intermediate transfer belt 15 reaches the position of the auxiliary roller 214, the switch 201 is switched and a bias having the same polarity as the normal charge polarity of the toner (i.e., the negative polarity in the present embodiment) is applied to the auxiliary roller 214. This causes electric repulsion between the toner image and the auxiliary roller 214, preventing toner adhesion to the auxiliary roller 214.

As such, by switching the switch 201 to apply the bias having the same polarity as the normal charge polarity of the toner (i.e., the negative polarity in the present embodiment) to the auxiliary roller 214, the toner having adhered to the auxiliary roller 214 can be electrostatically transferred from the auxiliary roller 214 to the intermediate transfer belt 15, enabling cleaning of the auxiliary roller 214.

In this way, by varying a bias to be applied to the auxiliary roller 214, when paper is conveyed, discharge is prevented at a pre-nip position (i.e., at a position immediately before the nip) between the recording medium 22 and the intermediate transfer belt 15. On the contrary, when no paper is conveyed, for example, when the process control or color registration is activated or during jam processing, the auxiliary roller 214 can be cleaned without being detached from the intermediate transfer belt 15.

Further, a power source is provided as a second bias applying unit that applies a bias to the secondary transfer roller 25. The power source can apply to the secondary transfer roller 25 a transfer bias (i.e., a bias having the positive polarity) for transferring a toner image from the intermediate transfer belt 15 to the recording medium 22, and a bias having a reverse polarity of the transfer bias (i.e., a bias having the negative polarity). Accordingly, when the secondary transfer is not performed, the toner having adhered to the secondary transfer roller 25 can be electrostatically transferred to the intermediate transfer belt 15 with application of the bias having the reverse polarity of the transfer bias (i.e., the bias having the negative polarity) to the secondary transfer roller 25. This enables cleaning of the secondary transfer roller 25 without a dedicated cleaning device, thereby achieving lower cost and space saving.

When the bias having the reverse polarity of the transfer bias (i.e., the bias having the negative polarity) is applied to the secondary transfer roller 25, at least the bias having the negative polarity may be applied to the auxiliary roller 214 as a cleaning bias (or the bias having the positive polarity and the bias having the negative polarity may alternately be applied, as described later). This enables cleaning of the auxiliary roller 214 while cleaning the secondary transfer roller 25, thus shortening the cleaning time. To clean the secondary transfer roller 25, the bias having the positive polarity and the bias having the negative polarity may alternately be applied. This enables the toner charged with various polarities to be electrostatically transferred from the secondary transfer roller to the intermediate transfer belt 15, thereby enabling cleaning of the secondary transfer roller 25 more reliably.

In this arrangement, a partition 231 is provided between the secondary transfer roller 25 and the auxiliary roller 214, and is grounded via a resistor of 100 MΩ. This prevents discharge due to the potential difference between the secondary transfer roller 25 and the auxiliary roller 214. The partition 231 may have a resistance ranging from 1 MΩ to 200 MΩ approximately. This prevents the above discharge, and also suppresses discharge due to the current leakage from the partition 231 or the electric charge accumulated in the partition 231.

The partition 231 is arranged such that, when the leading end of the recording medium 22 is conveyed from the auxiliary roller 214 to the secondary transfer nip N and the recording medium 22 is about to separate from the intermediate transfer belt 15, the recording medium 22 is guided to the secondary transfer nip N again. This prevents failure in conveying paper such as paper jam.

The auxiliary roller 214 has a length in the axial direction to match the entire width of the intermediate transfer belt 15. Thus, the auxiliary roller 214 can press the recording medium 22 entirely in a direction perpendicular to the movement direction of the intermediate transfer belt. By arranging the auxiliary roller 214 to cover the conveyed paper widthwise almost entirely, paper of various sizes from A4 (foolscap) to postcard can be handled. Further, the outer circumference surface of the auxiliary roller 214, i.e., pressing section, is formed with a high friction material such as a rubber, with which the recording medium 22 can be gripped. This allows the auxiliary roller 214 to rotate by a rotational drive force given from the recording medium 22 being conveyed. The rotation of the auxiliary roller 214 generates a load that gives a friction resistance causing at least the following rotation to the movement of the recording medium 22, allowing the movement resistance to be applied to the recording medium 22. This stretches a portion of the recording medium 22 between the secondary transfer nip N and the auxiliary roller 214, enabling to maintain the adhesion at a pre-transfer region (i.e., a region immediately before the transfer section).

Because the recording medium 22 is given a movement resistance that varies depending on the materials used for the surface of the auxiliary roller 214 and the recording medium 22 etc., a controlling unit may control the surface movement speed of the auxiliary roller 214. Specifically, for example, the auxiliary roller 214 is connected to a drive source serving as a driving unit and rotationally driven. Then, by controlling the drive source, the surface movement speed is adjusted. With this structure, by adjusting the circumferential speed of the auxiliary roller 214 appropriately depending on the type of the recording medium 22, a stable movement resistance can be applied to the recording medium 22. Thus, stable adhesiveness is achieved regardless of the type of the recording medium 22.

Under this control, forward-reverse control may be performed such that the auxiliary roller 214 rotates reversely, depending on the type of the recording medium 22 such as thick paper or thin paper. Preferably, an arbitrary value is set for a difference in linear speed between the recording medium 22 and the intermediate transfer belt 15 to achieve stable adhesiveness with the recording medium 22 of broader types.

Figure 3:
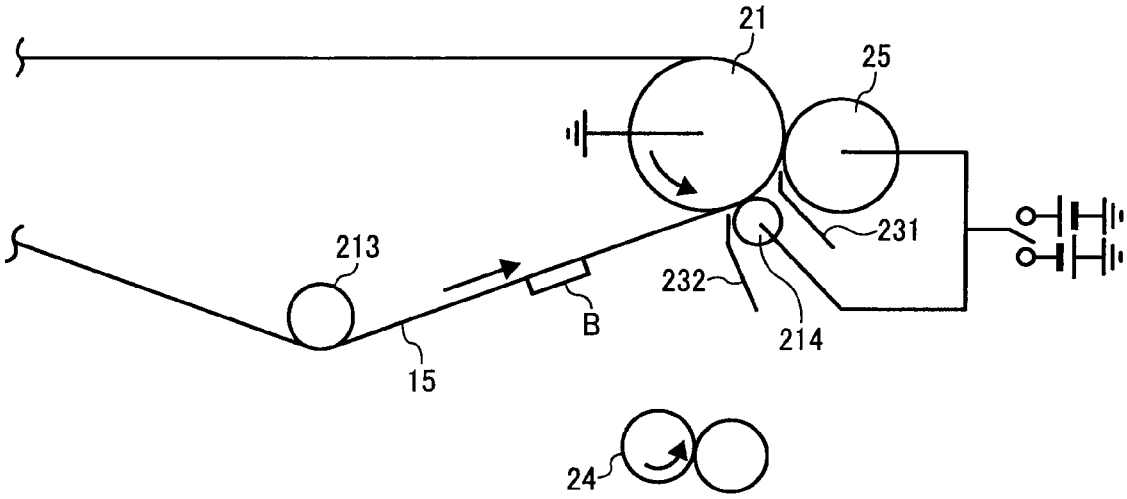
FIG. 3 is a schematic diagram of a portion, near the secondary transfer section, of the intermediate transfer unit according to a second arrangement of the present invention.

FIG. 3 depicts a condition that the recording medium 22 is not conveyed, for example, when the process control or color registration is activated or during jam processing. In this case, when the leading end of a toner image B on the intermediate transfer belt 15 reaches the position of the auxiliary roller 214, both the auxiliary roller 214 and the secondary transfer roller 25 are applied with a bias having the same polarity as the normal charge polarity of the toner (i.e., a bias having the negative polarity) and the same potential from the power source serving as the bias applying unit. This causes electric repulsion between the toner image and the auxiliary roller 214 and between the toner and the secondary transfer roller 25, thus suppressing the toner from adhering to the auxiliary roller 214 and the secondary transfer roller 25. By using a single power source as the bias applying unit commonly for the auxiliary roller 214 and the secondary transfer roller 25, a main body is configured with merit of low cost and space saving. Further, during the cleaning control of the secondary transfer roller 25, the assisting controller 214 is cleaned under similar control. This facilitates cleaning control.

Figure 4:
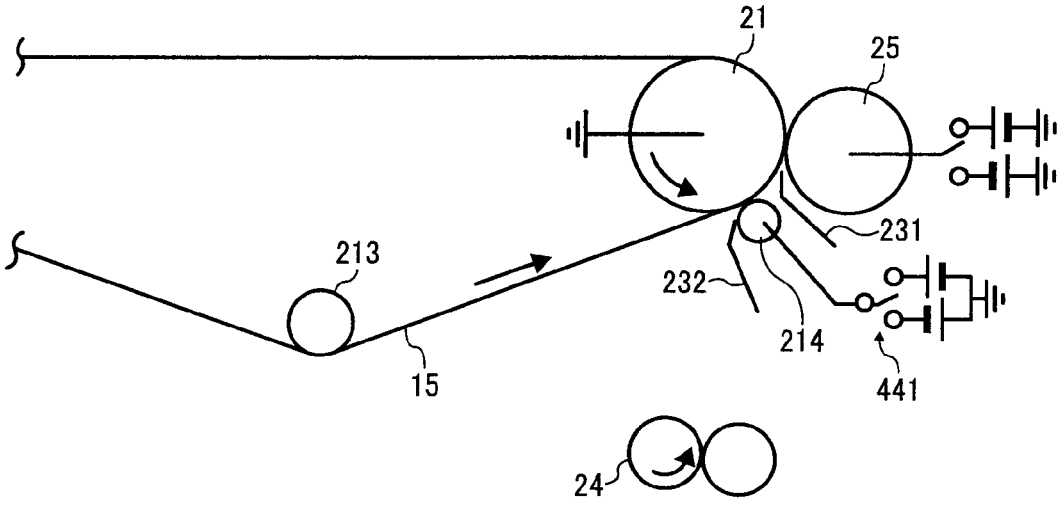
FIG. 4 is a schematic diagram of a portion, near the secondary transfer section, of the intermediate transfer unit according to a third arrangement of the present invention.

In FIG. 4, the bias having the positive polarity and the bias having the negative polarity can be selectively applied to the auxiliary roller 214 with a switch 441. Accordingly, the toner adhered to the auxiliary roller 214 and charged with various polarities can be electrostatically transferred from the auxiliary roller 214 to the intermediate transfer belt 15, enabling cleaning of the auxiliary roller 214 more reliably. The cleaning is performed by applying to the auxiliary roller 214 the bias having the positive polarity and the bias having the negative polarity with a rectangular waveform, until application of the first transfer bias, for example, before warming-up.

Figure 5:
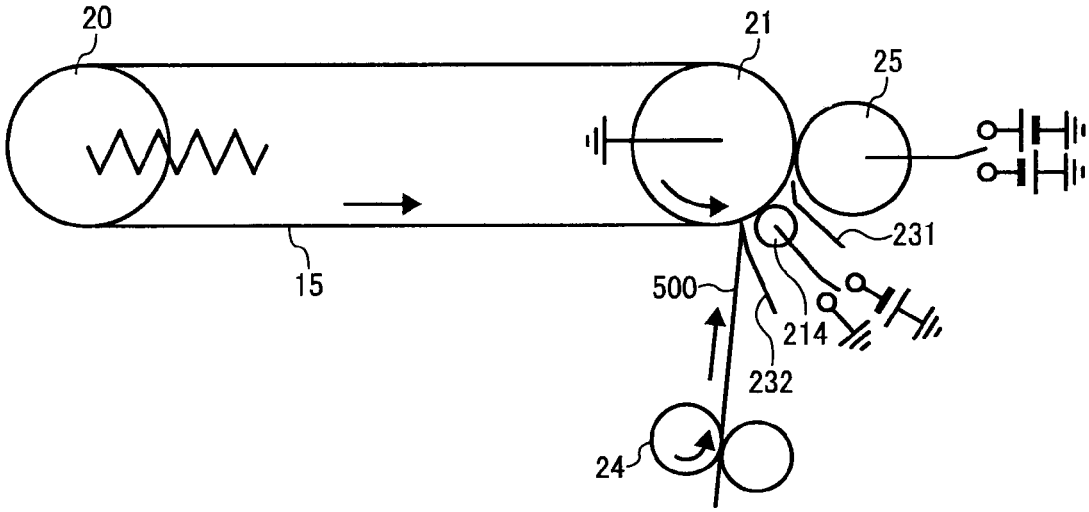
FIG. 5 is a schematic diagram of a portion, near the secondary transfer section, of the intermediate transfer unit according to a fourth arrangement of the present invention.

FIG. 5 depicts the intermediate transfer belt 15 including two axes: the secondary transfer facing roller 21 serving as a drive roller; and the tension roller 20 serving as a biasing roller. When no auxiliary roller 214 is provided, even by providing the first guiding member 232 near the secondary transfer roller 25, a slight gap inevitably occurs due to the large curvature of the secondary transfer nip N, causing discharge before the secondary transfer nip. For this reason, the auxiliary roller 214 is provided to cause the recording medium 22 to adhere to the intermediate transfer belt 15, thereby preventing image degradation due to the discharge before the secondary transfer nip.

A copier according to a second embodiment of the present invention basically has the same structure as the first embodiment. Because the constituting elements are basically the same as those of the first embodiment, the description is omitted.

Figure 6:
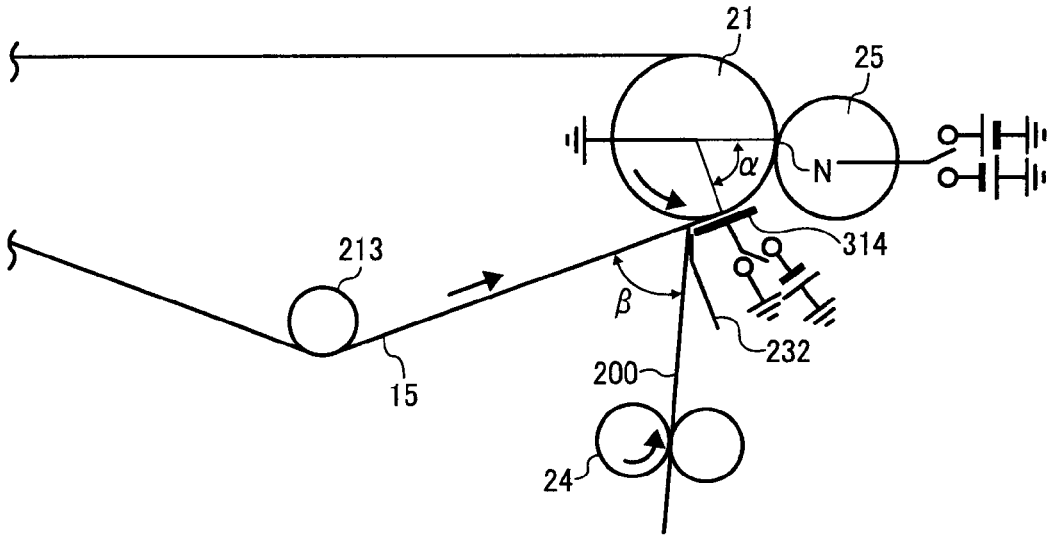
FIG. 6 is a schematic diagram of a portion, near the secondary transfer section, of the intermediate transfer unit according to a fifth arrangement of the present invention.

In an arrangement shown in FIG. 6, due to the reason described later, an angle $\alpha$ of 45° or greater (the angle $\alpha$ is 45° in FIG. 6) is formed between the center of the secondary transfer nip N and an interface where the intermediate transfer belt 15 contacts the secondary transfer facing roller 21 on the upstream side in the movement direction of the intermediate transfer belt. Further, an angle $\beta$ of 45° or greater (the angle $\beta$ is 60° in FIG. 6) is formed between the conveyance direction of the recording medium 22 and the intermediate transfer belt 15. Further, a guiding member 314 having a shape curving along the intermediate transfer belt 15 is provided up to immediately before the secondary transfer nip N in a non-contact manner. The guiding member 314 comes in contact with the recording medium 22, to cause the recording medium 22 to adhere to the intermediate transfer belt 15.

Figure 7:
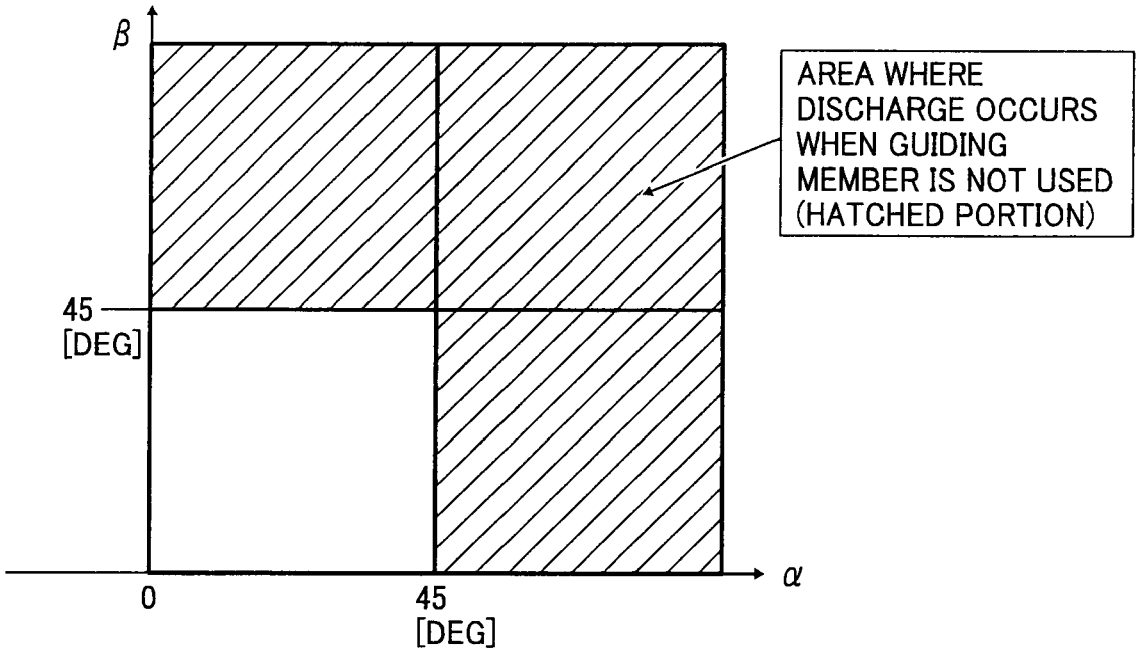
FIG. 7 a graph of an area where discharge occurs and an area where no discharge occurs in relation to angles $\alpha$ and $\beta$.

FIG. 7 and Table 1 show results of experiments performed to check the efficiency of suppressing the discharge before the secondary transfer, regarding whether the angles $\alpha$ and $\beta$ having the above ranges (the angle $\alpha \geqq 45°$ and the angle $\beta \geqq 45°$) are provided and whether the guiding member 314 is provided. As seen from Table 1, the experiments are roughly grouped into Experiments 1 to 5 and Experiments 6 to 10, depending on whether the guiding member 314 is provided. Further, the angles $\alpha$ and $\beta$ are set corresponding to each other between the groups. That is, comparison is made as to whether the discharge is suppressed depending on whether the guiding member 314 is provided in relation with the certain angles $\alpha$ and $\beta$.

TABLE 1

| | $\alpha$ (°) | $\beta$ (°) | Guiding member | Discharge |
|---|---|---|---|---|
| Experiment 1 | 45 | 45 | Used | No |
| Experiment 2 | 60 | 60 | Used | No |
| Experiment 3 | 60 | 60 | Used | No |
| Experiment 4 | 30 | 30 | Used | No |
| Experiment 5 | 30 | 30 | Used | No |
| Experiment 6 | 45 | 45 | Not used | Yes |
| Experiment 7 | 60 | 60 | Not used | Yes |
| Experiment 8 | 60 | 60 | Not used | Yes |
| Experiment 9 | 30 | 30 | Not used | Yes |
| Experiment 10 | 30 | 30 | Not used | No |

Experiments 1 to 3 and 6 to 8 show that the discharge occurs without the guiding member 314 due to a large curvature at a position before the secondary transfer nip. Experiments 4 and 9 show that the discharge phenomenon appears when a large conveyance angle (angle $\beta$) of the recording medium 22 is formed with the intermediate transfer belt 15. This is because the recording medium 22 fails to follow the intermediate transfer belt 15 without the guiding member 314 and thus a gap is generated before the secondary transfer nip. Experiments 5 and 10 show that no discharge occurs without the guiding member 314 due to a small curvature at the secondary transfer nip N. That is, when the angle $\alpha$ is not greater than 45°, no guiding member is required because the nip between the intermediate transfer belt 15 and the secondary transfer facing roller 21 is large. When the intermediate transfer unit 50 includes two axes, the guiding member 314 is required because the secondary transfer nip N becomes small and the discharge easily occurs before the secondary transfer. When the angle β is not greater than 45°, no guiding member is required because the recording medium 22 is conveyed following the intermediate transfer belt 15 before entering the position before the secondary transfer nip N.

As described, the angle of not less than 45° is set for the angle α formed between the center of the secondary transfer nip N and the interface where the intermediate transfer belt 15 contacts the secondary transfer facing roller 21 on the upstream side in the movement direction of the intermediate transfer belt, and the angle of not less than 45° is set for the angle β formed between the conveyance direction of the recording medium 22 and the intermediate transfer belt 15. Further, the guiding member 314 having a shape curving along the intermediate transfer belt 15 is provided up to immediately before the secondary transfer nip N. This structure prevents scattering of toner particles during the pre-transfer before the secondary transfer. Further, because the guiding member 314 is spaced from the intermediate transfer belt 15, the guiding member 314 is free from toner soil when the process control or color registration is activated or during jam processing.

Further, the bias having the same polarity as the normal charge polarity of the toner (i.e., the negative polarity in the present embodiment) is applied to the guiding member 314. This enables the toner having adhered to the guiding member 314 to be electrostatically transferred from the guiding member 314 to the intermediate transfer belt, thereby enabling cleaning of the guiding member 314.

Figure 8:
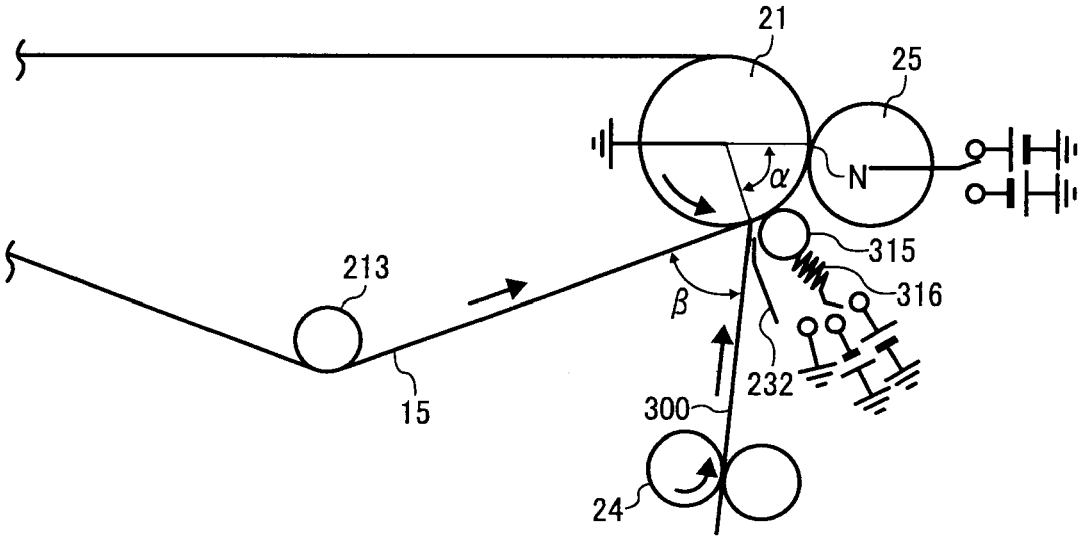
FIG. 8 is a schematic diagram of a portion, near the secondary transfer section, of the intermediate transfer unit according to a sixth arrangement of the present invention.

In an arrangement shown in FIG. 8, the angle of not less than 45° is set for the angle α formed between the center of the secondary transfer nip N and the interface where the intermediate transfer belt 15 contacts the secondary transfer facing roller 21 on the upstream side in the movement direction of the intermediate transfer belt, and the angle of not less than 45° is set for the angle β formed between the conveyance direction of the recording medium 22 and the intermediate transfer belt 15. Further, near an upstream position of the secondary transfer nip N in the movement direction of the intermediate transfer belt, an auxiliary roller 315 is detachably provided with respect to the intermediate transfer belt 15. The auxiliary roller 315 serves as an auxiliary member that causes the recording medium 22 to adhere to the intermediate transfer belt. The auxiliary roller 315 is rotatably supported, and includes a biasing unit 316 having a variable biasing force to handle the thick paper. While being in contact with the intermediate transfer belt 15, the auxiliary roller 315 is driven to press the recording medium 22 against the surface of the intermediate transfer belt 15 at the arrival of the leading end of the recording medium 22. Further, the auxiliary roller 315 detaches the recording medium 22 at the time when the tail end of the recording medium 22 passes through the pressure position. This structure also enables to suppress scattering of toner particles caused in the pre-transfer before the secondary transfer, as in the fifth arrangement.

When the recording medium 22 is sent out from the registration rollers 24, the recording medium 22 is guided to the first guiding member 232, and the leading end of the recording medium 22 hits a portion of the surface of the intermediate transfer belt 15, i.e., an upstream portion slightly away from the auxiliary roller 315 in the movement direction of the intermediate transfer belt. The leading end of the recording medium 22 is nipped between the auxiliary roller 315 and the intermediate transfer belt 15 when entering a position where a pressure is applied by the auxiliary roller 315. When the leading end of the recording medium 22 hits the surface of the intermediate transfer belt 15, a switch is switched and the auxiliary roller 315 is grounded. Accordingly, the auxiliary roller 315 and secondary transfer facing roller 21 are grounded to have the same potential. As a result, even when a slight gap occurs immediately before the auxiliary roller 315, image deterioration due to the discharge is prevented.

Assume that the recording medium 22 is not conveyed, for example, when the process control or color registration is activated or during jam processing. In this case, when the leading end of the toner image on the intermediate transfer belt 15 reaches the position of the auxiliary roller 315, the switch is switched and a bias having the same polarity as the normal charge polarity of the toner (i.e., the negative polarity in the present embodiment) is applied to the auxiliary roller 315. This causes electric repulsion between the toner image and the auxiliary roller 315, thereby preventing toner adhesion to the auxiliary roller 315.

As such, by switching the switch to apply the bias having the same polarity as the normal charge polarity of the toner (i.e., the negative polarity in the present embodiment) to the auxiliary roller 315, the toner having adhered to the auxiliary roller 315 can be electrostatically transferred from the auxiliary roller 315 to the intermediate transfer belt 15, enabling cleaning of the auxiliary roller 315.

In this way, by varying a bias to be applied to the auxiliary roller 315, when paper is conveyed, discharge is prevented at a pre-nip position between the recording medium 22 and the intermediate transfer belt 15. On the contrary, when no paper is conveyed, for example, when the process control or color registration is activated or during jam processing, the auxiliary roller 315 can be cleaned without being detached from the intermediate transfer belt 15.

Further, a power source is provided as the second bias applying unit that applies a bias to the secondary transfer roller 25. The power source can apply to the secondary transfer roller 25 a transfer bias (i.e., a bias having the positive polarity) for transferring a toner image from the intermediate transfer belt 15 to the recording medium 22, and a bias having a reverse polarity of the transfer bias (i.e., a bias having the negative polarity). Accordingly, when the secondary transfer is not performed, the toner having adhered to the secondary transfer roller 25 can be electrostatically transferred to the intermediate transfer belt 15 with application of the bias having the reverse polarity of the transfer bias (i.e., the negative polarity) to the secondary transfer roller 25. This enables cleaning of the secondary transfer roller 25 without a dedicated cleaning device, thereby achieving lower cost and space saving.

When the bias having the reverse polarity of the transfer bias (i.e., the bias having the negative polarity) is applied to the secondary transfer roller 25, at least the bias having the negative polarity may be applied to the auxiliary roller 315 as a cleaning bias. This enables cleaning of the auxiliary roller 315 while cleaning the secondary transfer roller 25, thus shortening the cleaning time. To clean the secondary transfer roller 25, the bias having the positive polarity and the bias having the negative polarity may alternately be applied. This enables the toner charged with various polarities to be electrostatically transferred from the secondary transfer roller to the intermediate transfer belt 15, enabling cleaning of the secondary transfer roller 25 more reliably.

The auxiliary roller 315 has a length in the axial direction to match entire width of the intermediate transfer belt 15. Thus, the auxiliary roller 315 can press the recording medium 22 entirely in a direction perpendicular to the movement direction of the intermediate transfer belt. By arranging the auxiliary roller 315 to cover the conveyed paper widthwise almost entirely, paper of various sizes from A4 (foolscap) to postcard can be handled. Further, the outer circumference surface of the auxiliary roller 315, i.e., pressing section, is formed with a high friction material such as a rubber, with which the recording medium 22 can be gripped. This allows the auxiliary roller 315 to rotate by a rotational drive force given from the recording medium 22 being conveyed. The rotation of the auxiliary roller 315 generates a load that gives a friction resistance causing at least the following rotation to the movement of the recording medium 22, allowing the movement resistance to be applied to the recording medium 22. This stretches a portion of the recording medium 22 between the secondary transfer nip N and the auxiliary roller 315 to maintain the adhesion at the pre-transfer region.

When the auxiliary roller 315 is configured as a rotation driving member, it is preferable that a circumferential speed V1 of the intermediate transfer belt 15 and a circumferential speed V2 of the auxiliary roller 315 be set to satisfy a condition V1=V2. Thus, the surface movement direction of the auxiliary roller 315 is preferably set to a direction in which the auxiliary roller 315 rotates following the recording medium 22 being conveyed. This allows the recording medium 22 to have a proper tension that enables the compatibility between the adhesiveness and conveyance. Further, because the recording medium 22 is given a movement resistance that varies depending on the materials used for the surface of the auxiliary roller 315 or the recording medium 22 etc., a control unit may control the surface movement speed of the auxiliary roller 315. Specifically, for example, the auxiliary roller 315 is connected to a drive source serving as a driving unit and rotationally driven. Then, by controlling the drive source, the surface movement speed is adjusted. With this structure, by adjusting the circumferential speed of the auxiliary roller 315 appropriately depending on the type of the recording medium 22, a stable movement resistance can be applied to the recording medium 22. Thus, stable adhesiveness is achieved regardless of the type of the recording medium 22.

Figure 9:
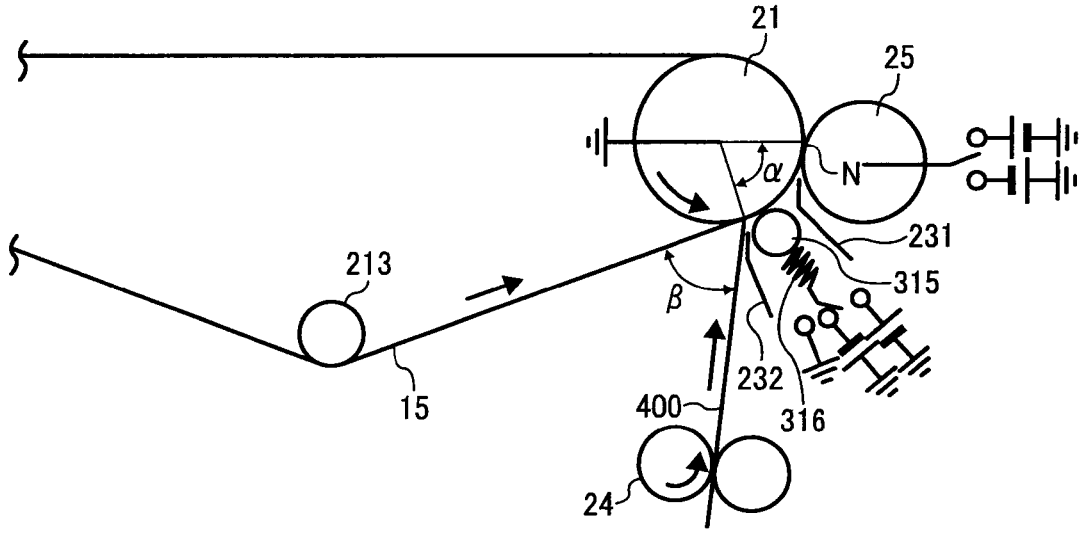
FIG. 9 is a schematic diagram of a portion, near the secondary transfer section, of the intermediate transfer unit according to a seventh arrangement of the present invention.

In an arrangement shown in FIG. 9, a second guiding member 431 is provided between the auxiliary roller 315 and the secondary transfer nip N. As the intermediate transfer belt 15 has a greater twining angle $\alpha$, the recording medium 22 is more likely affected by the curvature of the secondary transfer facing roller 21. Thus, by providing the second guiding member 431 on the upstream side of the secondary transfer nip N in the conveyance direction of the recording medium, the recording medium 22 is prevented from peeling off from the intermediate transfer belt 15, thereby preventing image turbulence due to the scattering of toner particles or discharge.

A copier according to a third embodiment of the present invention basically has the same structure as the first embodiment. Because the constituting elements are basically the same as those of the first embodiment, the description is omitted.

Figure 10:
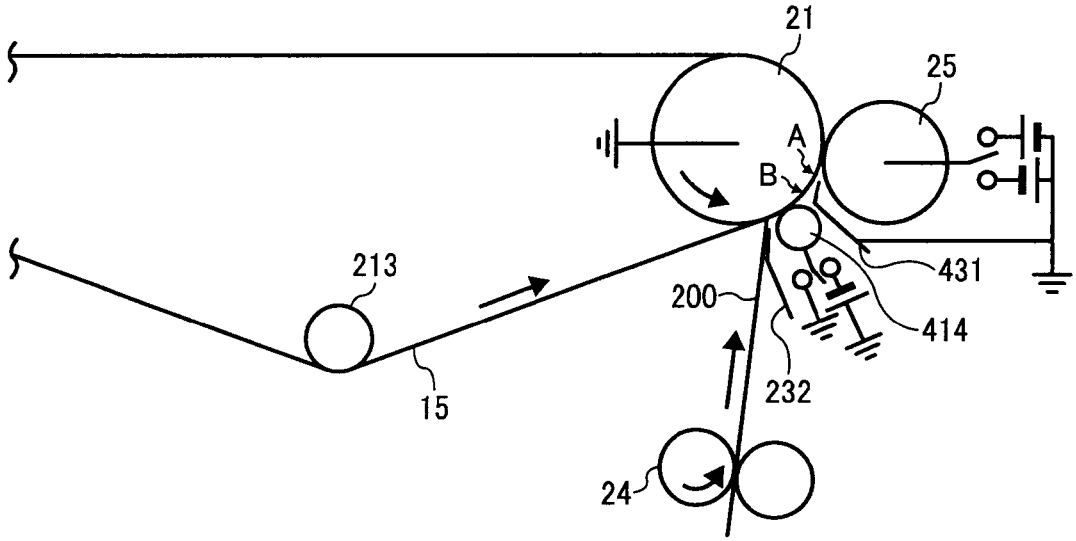
FIG. 10 is a schematic diagram of a portion, near the secondary transfer section, of the intermediate transfer unit according to an eighth arrangement of the present invention.

In FIG. 10, on the upstream side of the secondary transfer nip N in the movement direction of the intermediate transfer belt, an auxiliary roller 414 is provided to be in contact with the intermediate transfer belt 15. The auxiliary roller 414 serves as an auxiliary member that causes the recording medium 22 to adhere to the intermediate transfer belt 15. The auxiliary roller 414 is rotatably supported, and can be moved by a moving unit (not shown) toward the intermediate transfer belt 15. The auxiliary roller 414 presses the recording medium 22 against the surface of the intermediate transfer belt 15, at the time when the leading end of the recording medium 22 is conveyed while being in contact with the intermediate transfer belt 15.

For the auxiliary roller 414, a rubber roller or a rubber coating roller is used that is made of urethane rubber, silicon rubber, acrylic rubber, isoprene rubber, nitrile rubber, fluorine-containing rubber, or the like. This suppresses unstable conveyance of the recording medium, enabling to reduce errors such as transfer deviation.

When the recording medium 22 is sent out from the registration rollers 24, the recording medium 22 is guided to the first guiding member 232, and the leading end of the recording medium 22 hits a portion of the surface of the intermediate transfer belt 15, i.e., an upstream portion slightly away from the auxiliary roller 414 in the movement direction of the intermediate transfer belt. The leading end of the recording medium 22 is nipped between the auxiliary roller 414 and the intermediate transfer belt 15 at the time when entering a position where a pressure is applied by the auxiliary roller 414. When the leading end of the recording medium 22 hits the surface of the intermediate transfer belt 15, a switch is switched and the auxiliary roller 414 is grounded. Accordingly, the auxiliary roller 414 and the secondary transfer facing roller 21 are grounded to have the same potential. As a result, even when a slight gap occurs immediately before the auxiliary roller 414, image deterioration due to the discharge is prevented.

Assume that the recording medium 22 is not conveyed, for example, when the process control or color registration is activated or during jam processing. In this case, when the leading end of the toner image on the intermediate transfer belt 15 reaches the position of the auxiliary roller 414, the switch is switched and a bias having the same polarity as the normal charge polarity of the toner (i.e., the negative polarity in the present embodiment) is applied to the auxiliary roller 414. This causes electric repulsion between the toner image and the auxiliary roller 414, thereby preventing toner from adhering to the auxiliary roller 414.

As such, by switching the switch to apply the bias having the same polarity as the normal charge polarity of the toner (i.e., the negative polarity in the present embodiment) to the auxiliary roller 414, the toner having adhered to the auxiliary roller 414 can be electrostatically transferred from the auxiliary roller 414 to the intermediate transfer belt 15, enabling cleaning of the auxiliary roller 414.

In this way, by varying a bias to be applied to the auxiliary roller 414, when paper is conveyed, discharge is prevented at a pre-nip position between the recording medium 22 and the intermediate transfer belt 15. On the contrary, when no paper is conveyed, for example, when the process control or color registration is activated or during jam processing, the auxiliary roller 414 can be cleaned without being detached from the intermediate transfer belt 15.

Further, a power source is provided as the second bias applying unit that applies a bias to the secondary transfer roller 25. The power source can apply to the secondary transfer roller 25 two types of bias: a transfer bias (i.e., a bias having the positive polarity) for transferring a toner image from the intermediate transfer belt 15 to the recording medium 22; and a bias having a reverse polarity of the transfer bias (i.e., a bias having the negative polarity). Accordingly, when the secondary transfer is not performed, the toner having adhered to the secondary transfer roller 25 can be electrostatically transferred to the intermediate transfer belt 15 with application of the bias having the reverse polarity of the transfer bias (i.e., the bias having the negative polarity) to the secondary transfer roller 25. This enables cleaning of the secondary transfer roller 25 without a dedicated cleaning device, thereby achieving lower cost and space saving.

When the bias having the reverse polarity of the transfer bias (i.e., the bias having the negative polarity) is applied to the secondary transfer roller 25, at least the bias having the negative polarity may be applied to the auxiliary roller 414 as a cleaning bias. This enables cleaning of the auxiliary roller 414 while the secondary transfer roller 25 is cleaned, thus shortening the cleaning time. To clean the secondary transfer roller 25, the bias having the positive polarity and the bias having the negative polarity may alternately be applied. This enables the toner charged with various polarities to be electrostatically transferred from the secondary transfer roller to the intermediate transfer belt 15, enabling cleaning of the secondary transfer roller 25 more reliably.

The auxiliary roller 414 has a length in the axial direction to match entire width of the intermediate transfer belt 15. Thus, the auxiliary roller 414 can press the recording medium 22 entirely in a direction perpendicular to the movement direction of the intermediate transfer belt. By arranging the auxiliary roller 414 to cover the conveyed paper widthwise almost entirely, paper of various sizes from A4 (foolscap) to postcard can be handled. Further, the outer circumference surface of the auxiliary roller 414, i.e., pressing section, is formed with a high friction material such as a rubber, with which the recording medium 22 can be gripped. This allows the auxiliary roller 414 to rotate by a rotational drive force given from the recording medium 22 being conveyed. The rotation of the auxiliary roller 414 generates a load that gives a friction resistance causing at least the following rotation to the movement of the recording medium 22, allowing the movement resistance to be applied to the recording medium 22. This stretches a portion of the recording medium 22 between the secondary transfer nip N and the auxiliary roller 414, enabling to maintain the adhesion at the pre-transfer region.

Because the recording medium 22 is given a movement resistance that varies depending on the materials used for the surface of the auxiliary roller 414 and the recording medium 22 etc., a controlling unit may control the surface movement speed of the auxiliary roller 414. Specifically, for example, the auxiliary roller 414 is connected to a drive source serving as a driving unit and rotationally driven. Then, by controlling the drive source, the surface movement speed is adjusted. With this structure, by adjusting the circumferential speed of the auxiliary roller 414 appropriately depending on the type of the recording medium 22, a stable movement resistance can be applied to the recording medium 22. Thus, stable adhesiveness is achieved regardless of the type of the recording medium 22.

Under this control, forward-reverse control may be performed such that the auxiliary roller 414 rotates in a reversed direction, depending on the type of the recording medium 22 such as thick paper or thin paper. Preferably, an appropriate value is set for a difference in linear speed between the recording medium 22 and the intermediate transfer belt 15 to achieve stable adhesiveness with the recording medium 22 of broader types.

In this arrangement, the second guiding member 431 having a predetermined length is provided between the auxiliary roller 414 and the secondary transfer roller 25, and the second guiding member 431 and the intermediate transfer belt 15 have a clearance of A<B in between. With this structure, the recording medium 22 having passed through the auxiliary roller 414 can be guided to the secondary transfer nip N while being in close contact with the intermediate transfer belt 15. The second guiding member 431 is grounded via a resistor of 100 MΩ and there is little retention of the electric charge, so that discharge is prevented even when a small gap is generated immediately before the second guiding member 431. This arrangement prevents image turbulence due to the discharge or positional deviation, thereby achieving good output image. The guiding member itself may have a resistance ranging from 1 MΩ to 200 MΩ approximately. This prevents the above discharge, and also suppresses discharge due to the current leakage from the second guiding member 431 or the electric charge accumulated in the second guiding member 431.

The second guiding member 431 may include a detachment mechanism and have a clearance of A=the thickness of the recording medium<B with respect to the intermediate transfer belt 15. This assures adhesion of the recording medium to the intermediate transfer belt 15 immediately before entering the secondary transfer nip, while maintaining the transferability of the recording medium of broader types. On the contrary, when no paper is conveyed, specifically, when the process control or color registration is activated, the second guiding member 431 is out of contact with the intermediate transfer belt 15. This suppresses the toner adhesion to the guiding member 341, thereby preventing toner soil on the backside of the recording medium 22.

Figure 11:
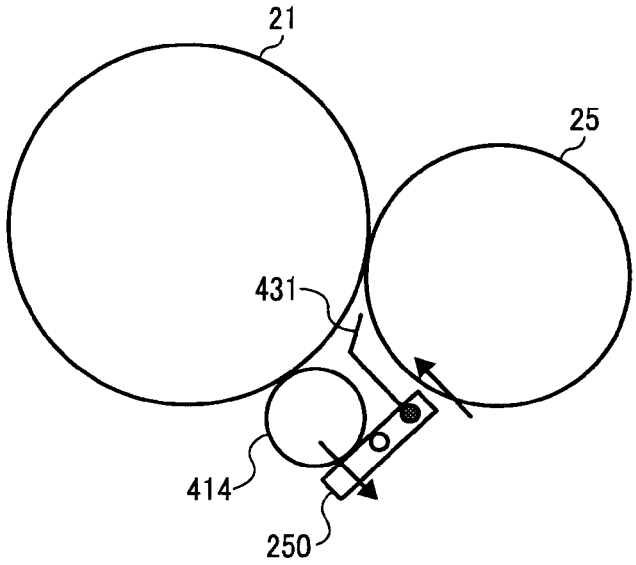
FIG. 11 is a schematic diagram of a detachment mechanism of a guiding member.

FIG. 11 depicts an exemplary detachment mechanism of the second guiding member 431. Because of the recording medium 22 entering the auxiliary roller 414, the auxiliary roller 414 is pressed, causing a lever 250 to push the second guiding member 431 toward the intermediate transfer belt 15. Further, when the recording medium 22 is passed through the auxiliary roller 414, the auxiliary roller 414 returns to its initial position and contacts the intermediate transfer belt 15. This causes the lever 250 to detach the second guiding member 431 from the intermediate transfer belt 15, then the second guiding member 431 returns to its original position. This structure simplifies the detachment mechanism of the second guiding member 431, however, the detachment mechanism is not limited to this. For example, the detachment mechanism may be arranged such that the second guiding member 431 is brought into contact with the intermediate transfer belt 15 before the leading end of the recording medium 22 reaches a clearance B, and that the second guiding member 431 is detached from the intermediate transfer belt 15 after the tail end of the recording medium 22 is passed through a clearance A.

Figure 12:
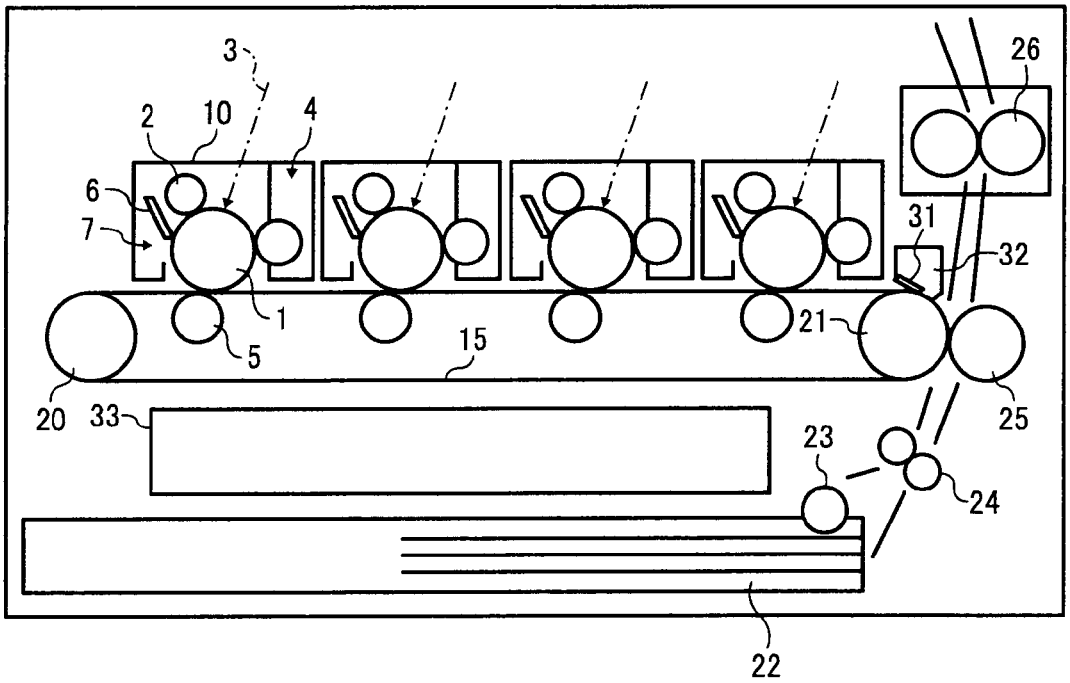
FIG. 12 is a schematic diagram of a printer using a two-axis intermediate transfer unit according to a fourth embodiment of the present invention.

As shown in FIG. 12, the copier according to the third embodiment basically has the same structure as the first embodiment, except that the intermediate transfer belt 15 is not stretched by the stretching roller 213, instead a two-axis intermediate transfer unit is used in which the intermediate transfer belt 15 is stretched by the tension roller 20 and the secondary transfer facing roller 21. Because the constituting elements are basically the same as those of the first embodiment, the description is omitted.

Figure 13:
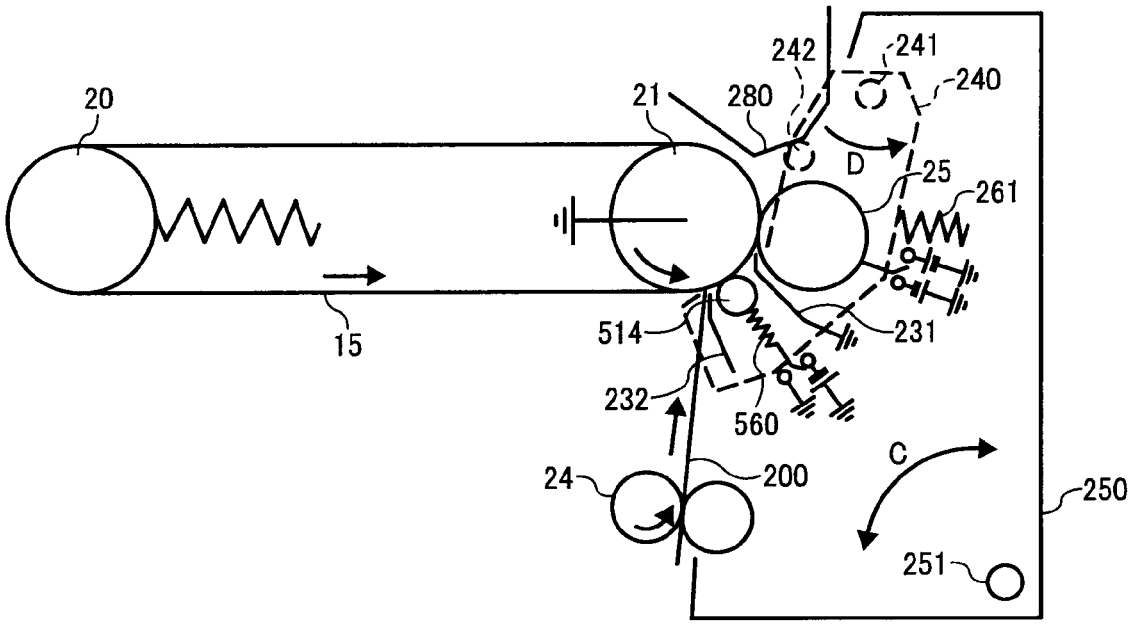
FIG. 13 is a schematic diagram of a portion, near the secondary transfer section, of the intermediate transfer unit according to a ninth arrangement of the present invention.

In an arrangement shown in FIG. 13, on the upstream side of the secondary transfer nip N formed between the secondary transfer roller 25 and the secondary transfer facing roller 21 in the movement direction of the intermediate transfer belt, an auxiliary roller 514 is provided to be in contact with the intermediate transfer belt 15. The auxiliary roller 514 serves as an auxiliary member that causes the recording medium 22 to adhere to the intermediate transfer belt 15. The auxiliary roller 514 is rotatably supported, biased by a spring 560 toward the intermediate transfer belt 15, and held in a housing 240 together with the secondary transfer roller 25. The housing 240 is held in the cover 250 that is provided on the apparatus main body to be capable of opening and closing in a direction orthogonal to the conveyance direction of the recording medium. Further, the housing 240 rotates about a housing rotation axis 241, and is biased by the spring 560 toward the intermediate transfer belt 15.

The auxiliary roller 514 presses the recording medium 22 against the surface of the intermediate transfer belt 15, at the time when the leading end of the recording medium 22 is conveyed while being in contact with the intermediate transfer belt 15. When the recording medium 22 is sent out from the registration rollers 24, the recording medium 22 is guided to the first guiding member 232, and the leading end of the recording medium 22 hits a portion of the surface of the intermediate transfer belt 15, i.e., an upstream portion slightly away from the auxiliary roller 514 in the movement direction of the intermediate transfer belt. The leading end of the recording medium 22 is nipped between the auxiliary roller 514 and the intermediate transfer belt 15 at the time when entering a position where a pressure is applied by the auxiliary roller 514. When the leading end of the recording medium 22 hits the surface of the intermediate transfer belt 15, a switch is switched and the auxiliary roller 514 is grounded. Accordingly, the auxiliary roller 514 and the secondary transfer facing roller 21 are grounded to have the same potential. As a result, even when a slight gap occurs immediately before the auxiliary roller 514, image deterioration due to the discharge is prevented.

Assume that the recording medium 22 is not conveyed, for example, when the process control or color registration is activated or during jam processing. In this case, when the leading end of the toner image on the intermediate transfer belt 15 reaches the position of the auxiliary roller 514, the switch is switched and a bias having the same polarity as the normal charge polarity of the toner (i.e., the negative polarity in the present embodiment) is applied to the auxiliary roller 514. This causes electric repulsion between the toner image and the auxiliary roller 514, thereby preventing toner adhesion to the auxiliary roller 514.

As such, by switching the switch to apply the bias having the same polarity as the normal charge polarity of the toner (i.e., the negative polarity in the present embodiment) to the auxiliary roller 514, the toner having adhered to the auxiliary roller 514 can be electrostatically transferred from the auxiliary roller 514 to the intermediate transfer belt 15, enabling cleaning of the auxiliary roller 514.

In this way, by varying a bias to be applied to the auxiliary roller 514, when paper is conveyed, discharge is prevented at a pre-nip position between the recording medium 22 and the intermediate transfer belt 15. On the contrary, when no paper is conveyed, for example, when the process control or color registration is activated or during jam processing, the auxiliary roller 514 can be cleaned without being detached from the intermediate transfer belt 15.

Further, a power source is provided as the second bias applying unit that applies a bias to the secondary transfer roller 25. The power source can apply to the secondary transfer roller 25 a transfer bias (i.e., a bias having the positive polarity) for transferring a toner image from the intermediate transfer belt 15 to the recording medium 22, and a bias having a reverse polarity of the transfer bias (i.e., a bias having the negative polarity). Accordingly, when the secondary transfer is not performed, the toner having adhered to the secondary transfer roller 25 can be electrostatically transferred to the intermediate transfer belt 15 by applying the bias having the reverse polarity of the transfer bias (i.e., the bias having the negative polarity) to the secondary transfer roller 25. This enables cleaning of the secondary transfer roller 25 without a dedicated cleaning device, thereby achieving lower cost and space saving.

When the bias having the reverse polarity of the transfer bias (i.e., the bias having the negative polarity) is applied to the secondary transfer roller 25, at least the bias having the negative polarity may be applied to the auxiliary roller 514 as a cleaning bias. This enables cleaning of the auxiliary roller 514 while cleaning the secondary transfer roller 25, thus shortening the cleaning time. To clean the secondary transfer roller 25, the bias having the positive polarity and the bias having the negative polarity may alternately be applied. This enables the toner charged with various polarities to be electrostatically transferred from the secondary transfer roller to the intermediate transfer belt 15, enabling cleaning of the secondary transfer roller 25 more reliably.

In this arrangement, the partition 231 is provided between the secondary transfer roller 25 and the auxiliary roller 514, and is grounded via a resistor of 100 MΩ. This prevents discharge due to the potential difference between the secondary transfer roller 210 and the auxiliary roller 514. The partition may have a resistance ranging from 1 MΩ to 200 MΩ approximately. This prevents the above discharge, and also suppresses discharge due to the current leakage from the partition 231 or the electric charge accumulated in the partition 231.

The partition 231 is arranged such that, when the leading end of the recording medium 22 is conveyed from the auxiliary roller 514 to the secondary transfer nip N and the recording medium 22 is about separate from the intermediate transfer belt 15, the recording medium 22 is guided to the secondary transfer nip N again. This prevents failure in conveying paper, such as paper jam.

The auxiliary roller 514 has a length in the axial direction to match entire width of the intermediate transfer belt 15. Thus, the auxiliary roller 514 can press the recording medium 22 entirely in a direction perpendicular to the movement direction of the intermediate transfer belt. By arranging the auxiliary roller 514 to cover the conveyed paper widthwise almost entirely, paper of various sizes from A4 (foolscap) to postcard can be handled. Further, the outer circumference surface of the auxiliary roller 514, i.e., pressing section, is formed with a high friction material such as a rubber, with which the recording medium 22 can be gripped. This allows the auxiliary roller 514 to rotate by a rotational drive force given from the recording medium 22 being conveyed. The rotation of the auxiliary roller 514 generates a load that gives a friction resistance causing at least the following rotation to the movement of the recording medium 22, allowing the movement resistance to be applied to the recording medium 22. This stretches a portion of the recording medium 22 between the secondary transfer nip N and the auxiliary roller 514, thereby enabling to maintain the adhesion at the pre-transfer region.

Because the recording medium 22 is given a movement resistance that varies depending on the materials used for the surface of the auxiliary roller 514 and the recording medium 22 etc., a controlling unit may control the surface movement speed of the auxiliary roller 514. Specifically, for example, the auxiliary roller 514 is connected to a drive source serving as a driving unit and rotationally driven. Then, by controlling the drive source, the surface movement speed is adjusted. With this structure, by adjusting the circumferential speed of the auxiliary roller 514 appropriately depending on the type of the recording medium 22, a stable movement resistance can be applied to the recording medium 22. Thus, stable adhesiveness is achieved regardless of the type of the recording medium 22.

Under this control, forward-reverse control may be performed such that the auxiliary roller 514 rotates in a reversed direction, depending on the type of the recording medium 22 such as thick paper or thin paper. Preferably, an appropriate value is set for a difference in linear speed between the recording medium 22 and the intermediate transfer belt 15 to achieve stable adhesiveness with the recording medium 22 of broader types.

When the cover 250 is opened for jam processing or the like, a detachment pin 242 provided in the housing 240 hits a detachment guide 280 provided on the apparatus main body side. This causes the housing 240 to rotate about the housing rotation axis 241 in a direction indicated by an arrow D, so that the secondary transfer roller 25 and the auxiliary roller 514 can be detached from the intermediate transfer belt 15. On the contrary, when the cover 250 is closed, the detachment pin 242 lies in a space near the detachment guide 280, so that the secondary transfer roller 25 is not biased. This allows opening and closing of the cover 250, without making scrapes on the intermediate transfer belt 15 with the auxiliary roller 514 and the first guiding member 232 both positioned deep inside.

Figure 14:
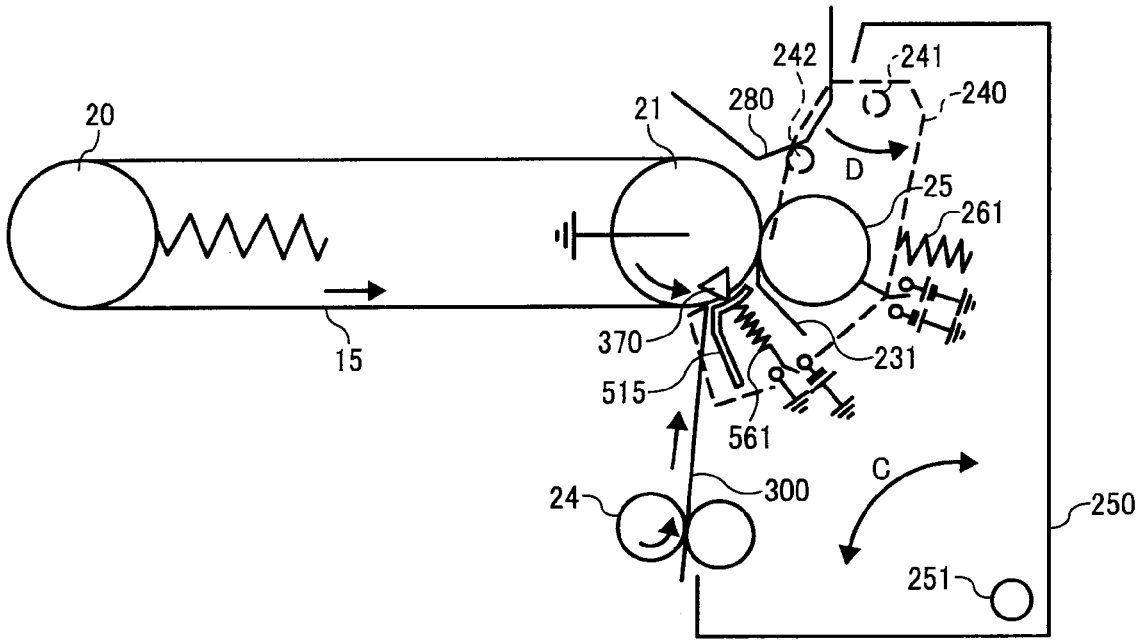
FIG. 14 is a schematic diagram of a portion, near the secondary transfer section, of the intermediate transfer unit according to a tenth arrangement of the present invention.

In an arrangement shown in FIG. 14, instead of the auxiliary roller 514 and the first guiding member 232 provided in the ninth arrangement, a pre-nip guiding member 515 is provided in a shape curving along the intermediate transfer belt 15, and that comes in contact with the recording medium 22 to cause the recording medium 22 to adhere to the intermediate transfer belt 15. The pre-nip guiding member 515 is held in the housing 240, biased by a spring 561 toward the center of the secondary transfer facing roller 21 to hit a positioning member 370, and forms a gap of a certain distance with the intermediate transfer belt 15. This prevents scattering of toner particles caused in the pre-transfer before the secondary transfer.

In this arrangement as in the ninth arrangement, when the cover 250 is opened or closed, the housing 240 rotates in the direction indicated by the arrow D. This also allows opening and closing of the cover 250, without making scrapes on the intermediate transfer belt 15 with the pre-nip guiding member 515 that forms a small gap with the intermediate transfer belt 15.

Further, the pre-nip guiding member 515 is applied with a bias having the same polarity as the normal charge polarity of the toner (i.e., the negative polarity in the present embodiment), via a spring 360. This enables the toner adhered to the pre-nip guiding member to be electrostatically transferred from the pre-nip guiding member 515 to the intermediate transfer belt 15, thereby cleaning the pre-nip guiding member 515.

Because the pre-nip guiding member 515 is detached from the intermediate transfer belt 15, the pre-nip guiding member 515 is kept away from toner soil when the process control or color registration is activated.

Figure 15:
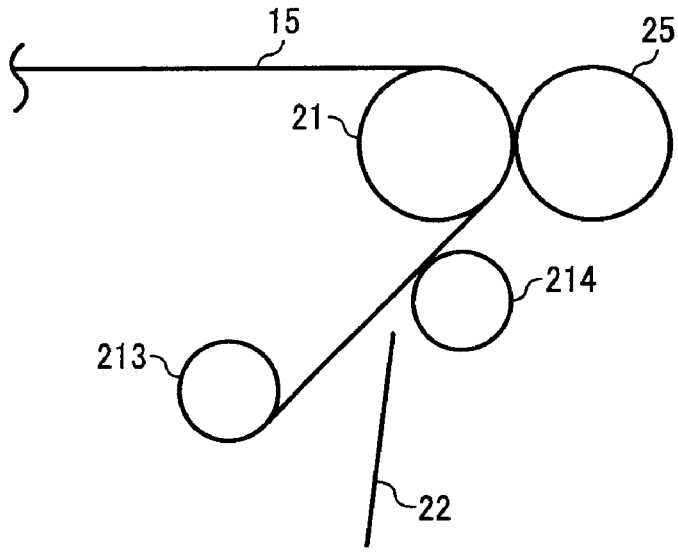
FIG. 15 is a schematic diagram of a portion, near the secondary transfer section, of the intermediate transfer unit in which an auxiliary roller is provided not to face a secondary transfer facing roller.
Figure 16:
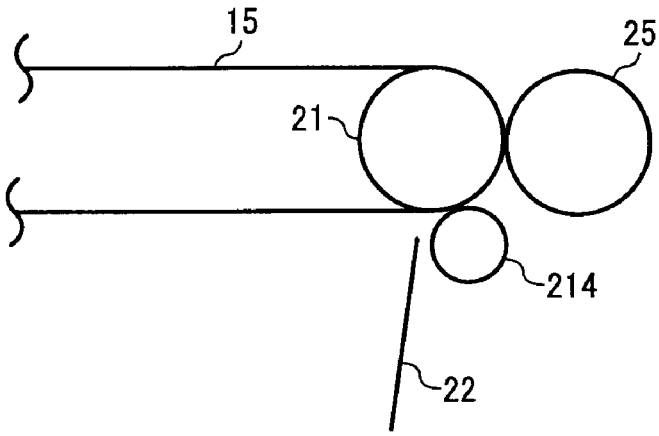
FIG. 16 is a schematic diagram of a portion, near a secondary transfer unit, of a two-axis intermediate transfer unit.

In the embodiments, the auxiliary rollers 214, 315, 414, 514, and the guiding member 314 or the pre-nip guiding member 515 are provided to face the secondary transfer facing roller 21. Those elements may be provided to face the intermediate transfer belt instead of the secondary transfer facing roller 21, as long as paper is stably conveyed. Specifically, when a sufficient space is provided before the secondary transfer section as in a multi-axis intermediate transfer unit including three or more axes as shown in FIG. 15, for example, the auxiliary roller 214 (the auxiliary rollers 315, 414, 514, and the guiding member 314 or the pre-nip guiding member 515 may be used similarly) can be provided not to face the secondary transfer facing roller 21. On the other hand, in a two-axis intermediate transfer unit as shown in FIG. 16, for example, the auxiliary roller 214 (the auxiliary rollers 315, 414, 514, and the guiding member 314 or the pre-nip guiding member 515 may be used similarly) needs to be provided to face the secondary transfer facing roller 21. Otherwise, paper may not be conveyed properly.

According to the present embodiments, the intermediate transfer unit 50 includes: the intermediate transfer belt 15, serving as a belt-like image carrier formed in a loop and endlessly moved while being stretched by a plurality of stretching rollers; the secondary transfer roller 25, serving as a transfer roller that faces one of the stretching rollers (i.e., the secondary transfer facing roller 21) with the intermediate transfer belt 15 therebetween, and comes in contact with an outer surface of the intermediate transfer belt to form the secondary transfer nip N; and the auxiliary roller 214, 315, 414, 514, the guiding member 314, or the pre-nip guiding member 514 serving as an auxiliary member that causes the recording medium 22 to adhere to the intermediate transfer belt 15 on the upstream side of the secondary transfer nip N in the movement direction of the intermediate transfer belt. The intermediate transfer unit 50 is a transfer device that transfers, after a toner image developed on the outer surface of each of the photosensitive elements 1 is transferred to the outer surface thereof, the toner image carried on the outer surface to the recording medium 22 nipped in the secondary transfer nip N. The intermediate transfer unit 50 further includes a power source serving as a bias applying unit that applies to the auxiliary roller 214, 315, 414, 514, the guiding member 314, or the pre-nip guiding member 515 a cleaning bias to electrostatically transfer the toner having adhered to the auxiliary roller 214, 315, 414, 514, the guiding member 314, or the pre-nip guiding member 515 to the intermediate transfer belt 15. Accordingly, with application of at least a bias having the same polarity as the normal charge polarity of the toner (i.e., the negative polarity in the present embodiments) as the cleaning bias to the auxiliary roller 214, 315, 414, 514, the guiding member 314, or the pre-nip guiding member 515, the toner having adhered to the auxiliary roller 214, 315, 414, 514, the guiding member 314, or the pre-nip guiding member 515 can be electrostatically transferred therefrom to the intermediate transfer belt 15, enabling cleaning of the auxiliary roller 214, 315, 414, 514, the guiding member 314, or the pre-nip guiding member 515. This suppresses toner soil on the recording medium 22 caused by the auxiliary roller 214, 315, 414, 514, the guiding member 314, or the pre-nip guiding member 515.

According to the embodiments, the secondary transfer facing roller 21 is provided to serve as a transfer facing roller and faces the secondary transfer roller 25 with the intermediate transfer belt 15 therebetween. Further, either one of the secondary transfer roller 25 and the secondary transfer facing roller 21 is applied with the bias and the other is grounded, allowing the auxiliary rollers 214, 315, 414, and 514 to have the same potential as the secondary transfer facing roller 21. Because the auxiliary rollers 214, 315, 414, and 514 have the same potential as the secondary transfer facing roller 21, discharge is prevented even when a small gap is generated immediately before the auxiliary roller 214, 315, 414, or 514. Thus, the image turbulence is prevented.

According to the embodiments, when the recording medium 22 is in contact with the intermediate transfer belt 15, the auxiliary rollers 214, 315, 414, and 514 are set to have the same potential as the secondary transfer facing roller 21. This reliably suppresses the discharge due to the generation of the small gap immediately before the auxiliary roller 214, 315, 414, or 514.

According to the embodiments, a power source is provided as the second bias applying unit that applies a bias to the secondary transfer roller 25. The power source can apply to the secondary transfer roller 25 a transfer bias (i.e., a bias having the positive polarity) for transferring the toner image from the intermediate transfer belt 15 to the recording medium 22, and a bias having a reverse polarity of the transfer bias (i.e., a bias having the negative polarity). Accordingly, when the secondary transfer is not performed, the toner having adhered to the secondary transfer roller 25 can be electrostatically transferred to the intermediate transfer belt 15 with application of the bias having the reverse polarity of the transfer bias (i.e., the bias having the negative polarity) to the secondary transfer roller 25. This enables cleaning of the secondary transfer roller 25 without a dedicated cleaning device, thereby achieving lower cost and space saving.

According to the embodiments, when the power source applies to the secondary transfer roller 25 at least the bias having the reverse polarity of the transfer bias, the power source applies the cleaning bias to the auxiliary rollers 214, 315, 414, and 514. This enables cleaning the auxiliary rollers 214, 315, 414, and 514, while cleaning of the secondary transfer roller 25, thus shortening the cleaning time.

According to the embodiments, when the recording medium 22 is not conveyed, i.e., when no paper is conveyed, the power source applies the cleaning bias to the auxiliary roller 214, 315, 414, or 514 at the time when the toner image on the intermediate transfer belt 15 reaches the position of the auxiliary roller 214, 315, 414, or 514. Further, the power source applies to the secondary transfer roller 25 at least the bias having the negative polarity, which is the bias having the reverse polarity of the transfer bias. This prevents adhesion of the toner carried on the intermediate transfer belt 15 to the auxiliary roller 214, 315, 414, or 514 with the electrostatic repulsion when no paper is passed, i.e., when the process control or color registration is activated or during jam processing. This eliminates the need of a mechanism that detaches the auxiliary rollers 214, 315, 414, 514, and the secondary transfer roller 25 from the intermediate transfer belt 15, thereby achieving low cost and space saving.

According to the embodiments, between the auxiliary roller 214, 315, 414, or 514 and the secondary transfer roller 25 is provided the second guiding member 431 or the partition 231 serving as a blocking member for blocking the electric field generated between the auxiliary roller 214, 315, 414, or 514 and the secondary transfer roller 25. This prevents discharge due to the potential difference between the secondary transfer roller 25 and the auxiliary roller 214 or the like.

According to the second embodiment, the guiding member 314 or the auxiliary roller 315 is provided upstream of the secondary transfer nip N in the movement direction of the intermediate transfer belt. Further, the angle of not less than 45° is set for the angle formed between the center of the secondary transfer nip N and the interface where the intermediate transfer belt 15 contacts the secondary transfer roller 25 on the upstream side in the movement direction of the intermediate transfer belt, and the angle of not less than 45° is set for the angle formed between the conveyance direction of the recording medium 22 and the movement direction of the intermediate transfer belt 15. This prevents scattering of toner particles caused in the pre-transfer before the secondary transfer.

According to the third embodiment, the second guiding member 431 having a predetermined length is provided along the intermediate transfer belt 15 at a portion between the secondary transfer roller 25 and the auxiliary roller 414, i.e., at a portion where the recording medium 22 contacts the second guiding member 431 before reaching the secondary transfer nip N. The second guiding member 431 has a first position closest to the secondary transfer roller 25, and a second position closest to the auxiliary roller 414, and the clearance A between the first position and the intermediate transfer belt 15 is set smaller than the clearance B between the second position and the intermediate transfer belt 15. With this arrangement, the recording medium 22 having passed through the auxiliary roller 414 can be guided to the secondary transfer nip N while being in close contact with the intermediate transfer belt 15. This prevents image turbulence due to the discharge or positional deviation, thereby achieving good output image.

According to the third embodiment, the second guiding member 431 is provided not to contact with the intermediate transfer belt 15. This suppresses toner adhesion to the second guiding member 431, thereby preventing toner soil on the backside of the recording medium 22.

According to the third embodiment, the second guiding member 431 is detachably provided with respect to the intermediate transfer belt 15. When paper is conveyed, transferability of the recording medium of broader types is maintained, also this ensures adhesiveness of the recording medium 22 to the intermediate transfer belt 15 immediately before reaching the secondary transfer nip. On the contrary, when no paper is conveyed, specifically, when the process control or color registration is activated, the second guiding member 431 is out of contact with the intermediate transfer belt 15. This suppresses toner adhesion to the second guiding member 431, thereby preventing toner soil on the backside of the recording medium 22.

According to the third embodiment, the second guiding member 431 contacts the intermediate transfer belt 15 before the leading end of the recording medium 22 reaches the second position, and is detached from the intermediate transfer belt 15 when the tail end of the recording medium 22 passes through the first position. This enables contact and detachment of the second guiding member 431 at appropriate timing.

According to the third embodiment, the second guiding member 431 contacts the intermediate transfer belt 15 when the recording medium 22 comes in contact with the auxiliary roller 414, and is detached from the intermediate transfer belt 15 when the recording medium 22 is out of contact with the auxiliary roller 414. This enables contact and detachment of the second guiding member 431 at appropriate timing.

According to the fourth embodiment, the housing 240 is provided to hold the auxiliary roller 514 or the pre-nip guiding member 515 and the secondary transfer roller 25. This realizes highly accurate positioning of the auxiliary roller 514 or the pre-nip guiding member 515 and the secondary transfer facing roller 21, so that the recording medium 22 can be accurately guided to the secondary transfer nip N while being in close contact with the intermediate transfer belt 15. This suppresses pre-nip discharge before the secondary transfer, and image deterioration.

According to the fourth embodiment, the housing 240 is held in the cover 250 that serves as a cover capable of rotationally moving with respect to the apparatus main body in the direction orthogonal to the transport direction of the recording medium 22 (the movement direction of the intermediate transfer belt). This enables opening and closing of the cover 250, without making scrapes on the intermediate transfer belt 15 with the auxiliary roller 514 or the pre-nip guiding member 515 and the first guiding member 232.

According to the embodiments, a printer that is an image forming apparatus includes: the photosensitive elements 1 each serving as a latent image carrier that carries a latent image thereon; the exposing units 3 serving as latent image forming units that form latent images on the photosensitive elements 1; the developers 4 serving as developing units that develop the latent images on the photosensitive elements 1 with toner; and the transfer unit that transfers the toner image developed on the photosensitive element 1 to the recording medium 22 via the intermediate transfer belt 15. In the printer, by using the intermediate transfer unit 50, which is a transfer device serving as a transfer unit according to the present invention, the auxiliary roller 514 and the guiding member 314 or the pre-nip guiding member 515 can be electrostatically cleaned, thereby achieving the various advantages described above.

As described, according to an aspect of the present invention, such excellent advantages are achieved as cleaning toner soil on the auxiliary member, and preventing toner soil on the recording medium when an auxiliary member contacts the recording medium.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device that includes an endless belt that is supported by a plurality of rollers, a first transfer roller that comes in contact with an outer surface of the belt to form a transfer nip, and an auxiliary member that makes contact with a recording medium on an upstream side of the transfer nip in a movement direction of the belt, to cause the recording medium to be in close contact with the outer surface of the belt, the transfer device transferring a toner image formed on the outer surface of the belt to the recording medium nipped in the transfer nip, the transfer device comprising:

a first bias applying unit that applies to the auxiliary member a first bias for electrostatically transferring a toner adhered to the auxiliary member to the outer surface of the belt.

2. The transfer device according to claim 1, further comprising:

a second transfer roller arranged in opposite to the first transfer roller across the belt, wherein the first bias applying unit applies the first bias to one of the first transfer roller and the second transfer roller while the other is grounded, and the auxiliary member has same potential as the second transfer roller.

3. The transfer device according to claim 2, wherein the auxiliary member and the second transfer roller have the same potential when the recording medium makes contact with the belt.

4. The transfer device according to claim 1, further comprising:

a second bias applying unit that applies a second bias to the first transfer roller, wherein the second bias includes a transfer bias for transferring the toner image from the outer surface of the belt to the recording medium, and a reverse bias having a polarity reverse to the transfer bias.

5. The transfer device according to claim 4, wherein the first bias applying unit applies the first bias to the auxiliary member when the second bias applying unit applies at least the reverse bias to the first transfer roller.

6. The transfer device according to claim 4, wherein when the toner image on the outer surface of the belt reaches the auxiliary member while the recording medium is not conveyed, the first bias applying unit applies the first bias to the auxiliary member, and the second bias applying unit applies at least the reverse bias to the first transfer roller.

7. The transfer device according to claim 1, further comprising:

a shield member that shields an electric field generated between the auxiliary member and the first transfer roller.

8. The transfer device according to claim 1, wherein the rollers are formed with a drive axis of a drive roller that drives the belt and a support axis of a support roller that applies a tension to the belt.

9. The transfer device according to claim 1, wherein an angle between a line connecting a center of the second transfer roller and a center of the transfer nip and a line connecting the center of the second transfer roller and a contact point of the second transfer roller with the belt on the upstream side is equal to or larger than 45 degrees, and an angle between a conveying direction in which the recording medium is conveyed to the belt and the movement direction of the belt is equal to or larger than 45 degrees.

10. The transfer device according to claim 1, further comprising:

a guiding member that is provided at a position between the first transfer roller and the auxiliary member, at which the guiding member contacts the recording medium before the recording medium reaching the transfer nip, the guiding member having a predetermined length along the belt, wherein a space between the belt and a first position of the guiding member close to the first transfer roller is smaller than a space between the belt and a second position close to the auxiliary member.

11. The transfer device according to claim 10, wherein the guiding member is provided not to contact the belt.

12. The transfer device according to claim 10, wherein the guiding member is detachable with respect to the belt.

13. The transfer device according to claim 12, wherein the guiding member makes contact with the belt before a leading edge of the recording medium reaches the second position, and is detached from the belt after a trailing edge of the recording medium passes the first position.

14. The transfer device according to claim 13, wherein a contact of the recording medium with the auxiliary member causes the guiding member to make contact with the belt, and the recording medium leaving the auxiliary member causes the guiding member to be detached from the belt.

15. The transfer device according to claim 1, further comprising:

a housing that accommodates the auxiliary member and the first transfer roller.

16. An image forming apparatus comprising:

an image carrier on which a latent image is formed;

a latent image forming unit that forms the latent image on the image carrier;

a developing unit that develops the latent image formed on the image carrier with toner to form a toner image; and a transfer unit that transfers the toner image formed on the image carrier to a recording medium, wherein the transfer unit includes an endless belt that is supported by a plurality of rollers and makes an endless movement, a transfer roller that comes in contact with an outer surface of the belt to form a transfer nip, an auxiliary member that makes contact with the recording medium on an upstream side of the transfer nip in a movement direction of the belt, to cause the recording medium to be in close contact with the outer surface of the belt, and a bias applying unit that applies to the auxiliary member a bias for electrostatically transferring a toner adhered to the auxiliary member to the outer surface of the belt.

17. An image forming apparatus comprising:

an image carrier on which a latent image is formed;

a latent image forming unit that forms the latent image on the image carrier;

a developing unit that develops the latent image formed on the image carrier with toner to form a toner image; and a transfer unit that transfers the toner image formed on the image carrier to a recording medium, wherein the transfer unit includes an endless belt that is supported by a plurality of rollers and makes an endless movement, a transfer roller that comes in contact with an outer surface of the belt to form a transfer nip, an auxiliary member that makes contact with the recording medium on an upstream side of the transfer nip in a movement direction of the belt, to cause the recording medium to be in close contact with the outer surface of the belt, a bias applying unit that applies to the auxiliary member a bias for electrostatically transferring a toner adhered to the auxiliary member to the outer surface of the belt, and a housing that accommodates the auxiliary member and the transfer roller, and the housing is held on a cover rotatable with respect to a main body of the image forming apparatus in a direction perpendicular to a conveying direction of the recording medium.

* * * * *